US005566506A

United States Patent [19]

Phillips

[11] Patent Number: 5,566,506

[45] Date of Patent: Oct. 22, 1996

[54] GRAIN BIN LID OPENER

[76] Inventor: Kenneth D. Phillips, R.R. 1 Box 346, McClure, Ill. 62957

[21] Appl. No.: 553,785

[22] Filed: Oct. 23, 1995

[51] Int. Cl.[6] ..... E05F 11/00

[52] U.S. Cl. ..... 49/357; 49/347; 49/394; 52/192; 220/263

[58] Field of Search ..... 49/357, 347, 394, 49/324; 220/263, 262, 264; 52/192

[56] References Cited

U.S. PATENT DOCUMENTS

| | | | |
|---|---|---|---|
| 2,495,505 | 1/1950 | Bella | 220/263 X |
| 3,064,931 | 11/1962 | Rowe . | |
| 3,349,516 | 10/1967 | Armstrong | 49/357 X |
| 3,733,764 | 5/1973 | Hege | 49/357 X |
| 4,208,839 | 6/1980 | Candy, Sr. . | |
| 4,267,936 | 5/1981 | Pavlicek . | |
| 4,327,522 | 5/1982 | Meadows . | |
| 4,598,496 | 7/1986 | Van Daele . | |
| 4,625,888 | 12/1986 | Thompson . | |
| 4,747,244 | 5/1988 | Christianson . | |
| 5,218,784 | 6/1993 | Pollock . | |
| 5,249,392 | 10/1993 | Houston et al. . | |

FOREIGN PATENT DOCUMENTS

| | | |
|---|---|---|
| 1083771 | 8/1980 | Canada . |

*Primary Examiner*—Philip C. Kannan
*Attorney, Agent, or Firm*—Richard C. Litman

[57] ABSTRACT

A grain bin lid opener designed to selectively open and close the lid from ground level. A single cable originates from the ground level on one side of the grain bin, proceeds over the grain bin and through the top part of a galvanized pipe and then extends down the other side. The cable is secured at the top part of the galvanized pipe which is welded to the grain bin lid. To close the lid, the cable is looped over a closing lever arm, located near ground level, which is then lowered therefore closing the lid. To secure the lid the lever arm is locked in a bracket. To open the lid the lever arm is released from the bracket and the cable is pulled from the other side of the grain bin. The grain bin lid opener allows the lid to be actuated from the ground level, thus preventing possible injury to a worker who would otherwise have to climb a tall grain bin to open the lid.

6 Claims, 3 Drawing Sheets

GRAIN BIN LID OPENER

BACKGROUND OF THE INVENTION

1. Field of the Invention

The present invention relates generally to a grain bin lid opener; more specifically, the invention relates to a lid opener that utilizes a single cable to open and close the lid from ground level.

2. Description of the Prior Art

There are many instances when a grain bin lid must be opened, for instance, to fill the bin or to aerate the grain. The normal procedure requires the farmer or grain handler to physically climb to the top of the tall grain bin structure and manually open the lid. As would be expected, persons climbing these tall structures often experience injures due to falling off the structure. These injures hinder productivity and increase costs. There is, therefore, a need for a grain bin lid opener that eliminates injury to the workers, promotes a safe working environment, is accessible by handicap individuals, uses a single cable to open and close the lid, uses a reliable locking device to secure the lid, and eliminates the need to climb to the top of the grain bin. The present invention provides such an apparatus.

Grain bin lid openers have been described in the patent literature, for instance, U.S. Pat. Nos. 4,208,839 issued to Candy, Sr. on Jun. 24, 1980, 4,267,936 issued to Pavlicek on May 19, 1981, 4,625,888 issued to Thompson on Dec. 2, 1986, 4,747,244 issued to Christianson on May 31, 1988, 5,218,784 issued to Pollock on Jun. 15, 1993, 4,327,522 issued to Meadows on May 4, 1982, 4,598,496 issued to Van Daele on Jul. 8, 1986 and Canadian Pat. No. 1,083,771 issued to Hrycyk on Aug. 19, 1980 all describe remotely operated closure devices but lack any disclosure of a U-shaped bracket to hold a closure handle in a locked position, a single cable running from one side of the grain bin to the other wherein the cable has a loop on one end dimensioned and configured to slide over the end of the closure handle.

U.S. Pat. Nos. 3,064,931 issued to Rowe on Nov. 20, 1962 and 5,249,392 issued to Houston et al. on Oct. 5, 1993 both fail to disclose either an apparatus for actuating the lid of a grain bin or a cable in conjunction with a closure handle and bracket.

None of the above inventions and patents, taken either singly or in combination, is seen to describe the instant invention as claimed.

SUMMARY OF THE INVENTION

Accordingly, it is a principal object of the invention to provide a ground actuated grain bin lid opener that employs a single cable.

It is another object of the invention to provide a grain bin lid opener having a closing lever arm.

It is a further object of the invention to provide a closing lever arm that is pivotable and useful in securing the grain bin lid.

Still another object of the invention is to provide a U-shaped bracket to secure the closing lever arm.

It is yet a further object of the invention to provide a cable having a loop on one end wherein the loop is dimensioned and configured to fit over the closing lever arm.

It is again an object of the invention to provide cable clamps to adjust the length of the cable.

An additional object of the invention is to provide a grain bin lid opener wherein the cable extends from one side of the bin over to the opposite side.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
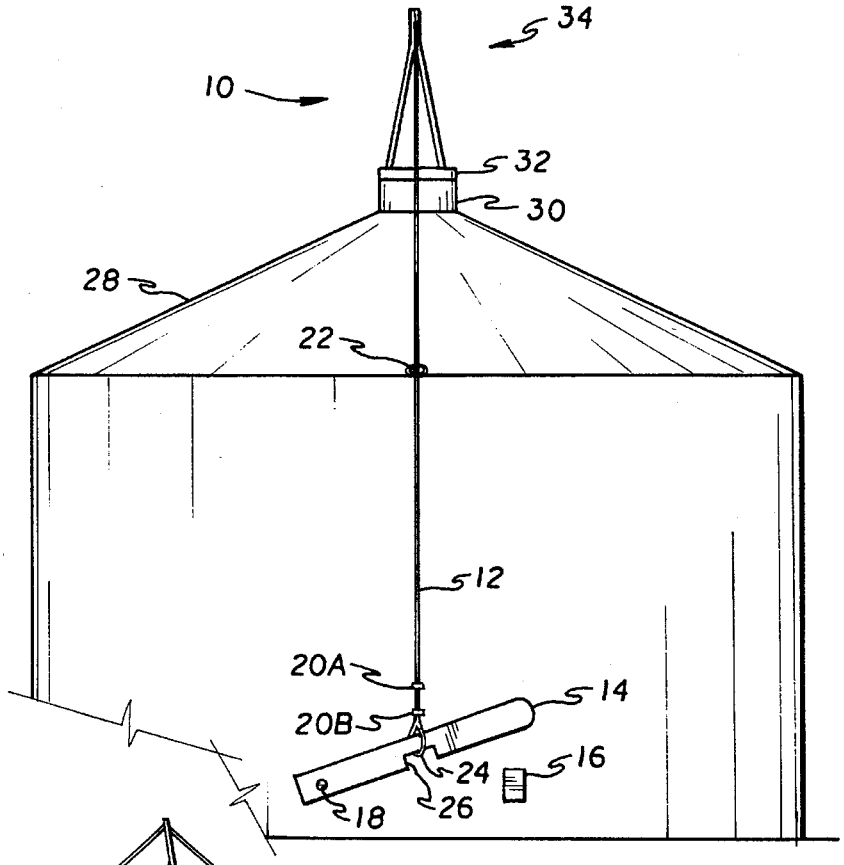
FIG. 1 is a partial, left side environmental view of the present invention.
Figure 2:
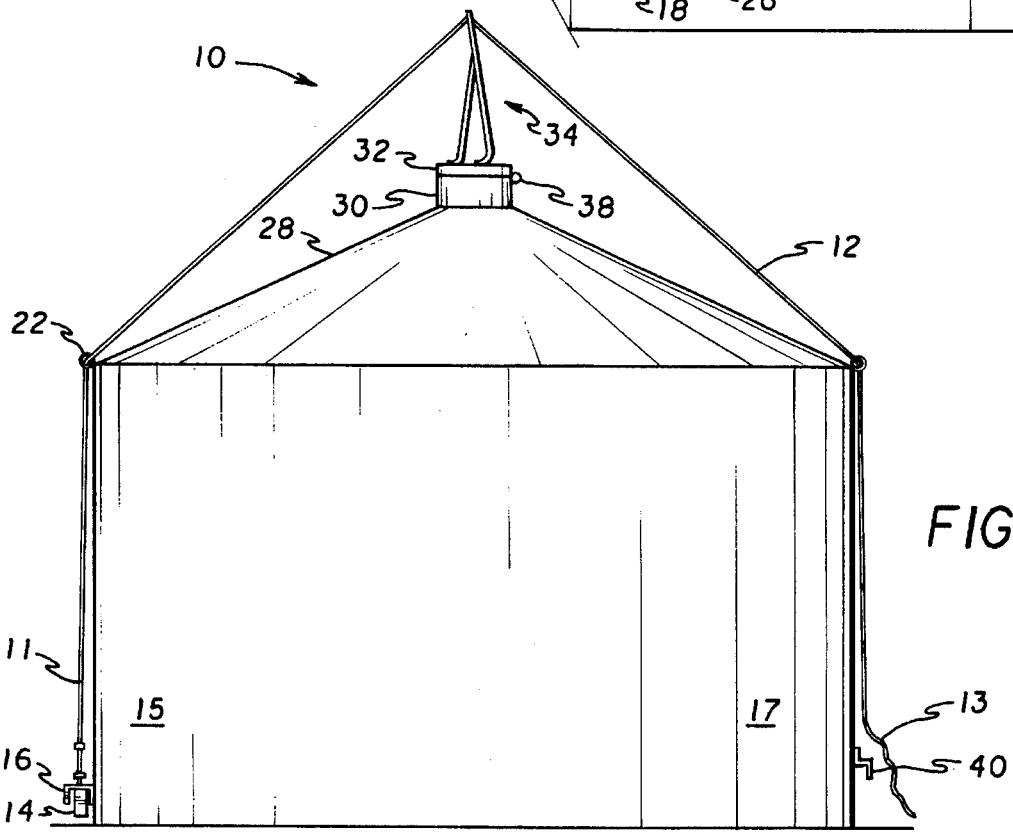
FIG. 2 is a front environmental view of the present invention.

Turning now to FIGS. 1 and 2 of the drawings, the cable 12 of lid operating system, seen generally at 10, is shown originating from a first side 15 of the grain bin storage structure 28, extending over the top of storage structure 28 and terminating at a second side 17. The lid operating system 10 enables a grain operator to open the lid 32 without having to climb to the top of the storage structure. To close and lock the lid, the user places loop 24 of cable 12 into notch 26 of securing arm 14 and then places securing arm 14 into U-shaped bracket 16.

Figure 4:
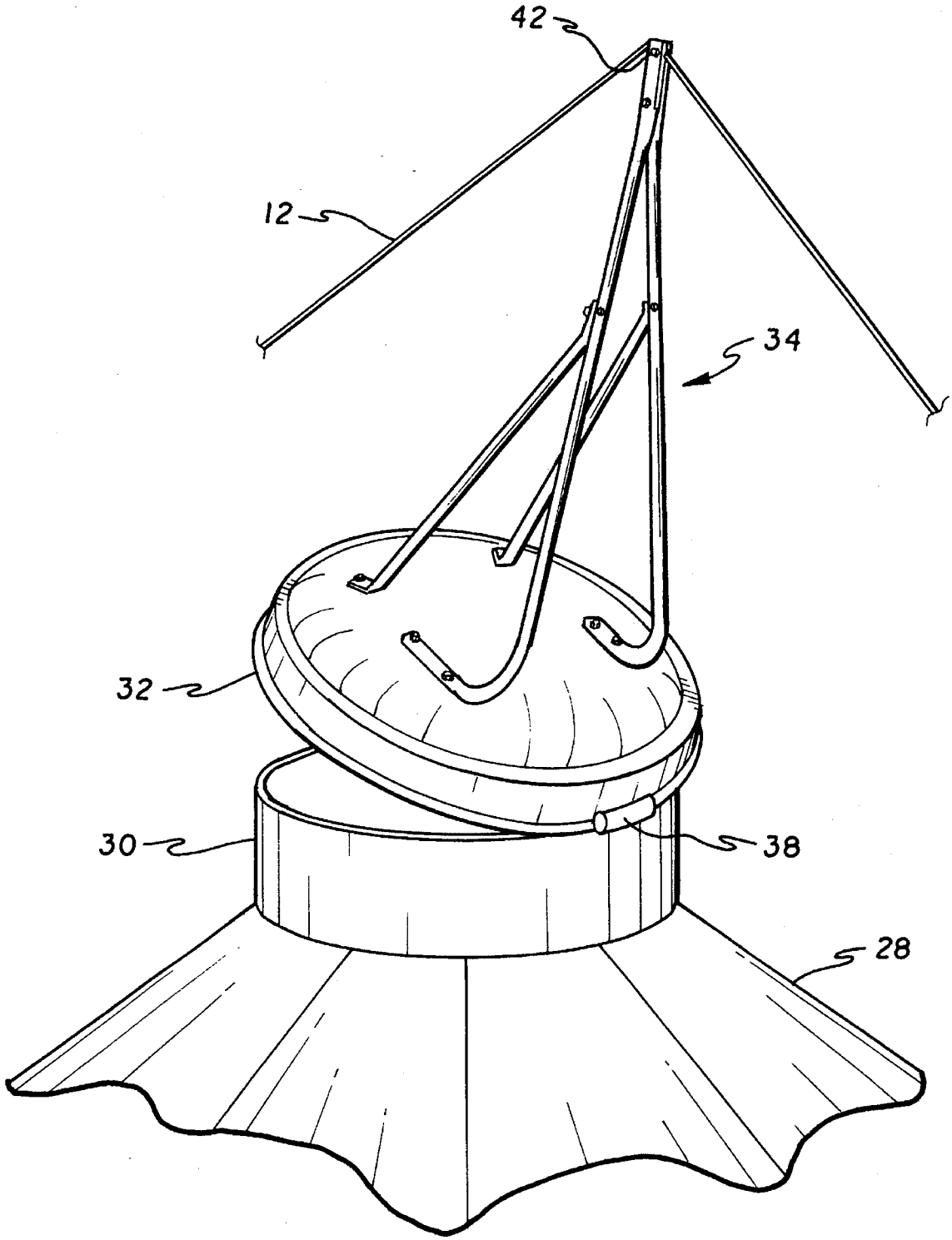
FIG. 4 is an enlarged scale, detail view showing the grain bin lid and cable.

To open lid 32, the user disengages securing arm 14 from bracket 16 and exerts a downward force on the second end 13 of cable 12. This in turn causes brace 34 to tilt which forces lid 32 into an open position, as shown in FIG. 4. To secure the lid in the open position, the user simply wraps the second end 13 of cable 12 around holding bracket 40.

To close lid 32, the user detaches cable 12 from holding bracket 40 and applies a downward force on the first end 11 of cable 12. The downward forces causes the brace 34 to return to its original position which forces lid 32 into a closed position. The user then locks lid 32 as described above.

Located along the edges of storage structure 28 are guide eyebolts 22 which assist in maintaining cable 12 in a substantially direct line from the first side 15 to the second side 17 of storage structure 28.

Figure 3:
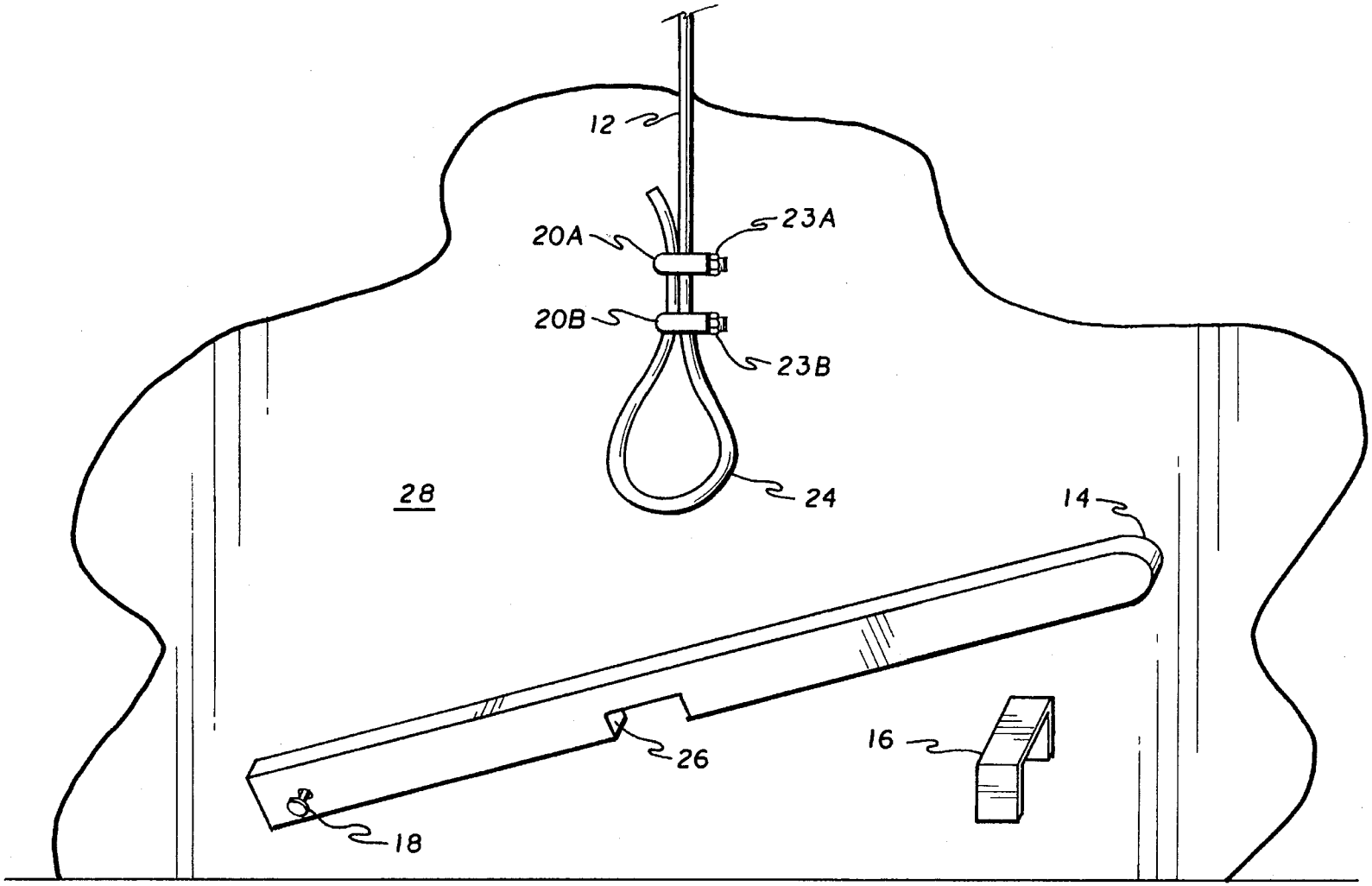
FIG. 3 is an enlarged scale, partially exploded, detail view showing the closing lever arm, U-shaped bracket and cable.

Now turning to FIG. 3 of the drawings, cable 12 is shown with cable clamps 20A, 20B. Cable clamps 20A, 20B are used to shorten or lengthen cable 12 by adjusting the width and position of loop 24. Nuts or fasteners 23A, 23B secure cable 12 within cable clamps 20A, 20B. Although cable clamps are shown, any fastening means that will adjust the width and position of loop 24 would be acceptable. To adjust loop 24, nuts 23A, 23B are loosened, allowing cable 12 to slide freely between cable clamps 20A, 20B. When the desired loop size is obtained, nuts 23A, 23B are tightened, therefore preventing movement of cable 12 within cable clamps 20A, 20B. Securing arm 14 is shown pivotally attached to storage structure 28 through pivot pin 18.

U-shaped bracket 16 is attached to storage structure 28 by welding or any other appropriate means. Notch 26 of securing arm 14 is dimensioned and configured to receive loop 24, and has a non-slip surface designed to retain loop 24 therein.

Turning now to FIG. 4, brace 34 is attached via bolts or welding to lid 32. Affixed to the top of brace 34 is cable 12. The lid 32 is shown in a partially opened position wherein lid 32 is pivoted about hinge 38 upon the uppermost segment 30 of storage structure 28. Attachment means 42 fastens cable 12 to brace 34. The attachment means 42 can comprise either bolts, screws, welding or any appropriate means that will secure the cable 12 to brace 34. Although lid 32 is shown pivotally attached to the uppermost segment 30 of storage structure 28, an alternative attachment would provide a slidable relationship between lid 32 and segment 30. The slidable relationship would work in a similar fashion as the pivotable relationship disclosed above. For example, a downward force on cable 12 in one direction would force lid 32 in an open position while a downward force on cable 12 in an opposite direction would close lid 32.

It is to be understood that the present invention is not limited to the sole embodiment described above, but encompasses any and all embodiments within the scope of the following claims.

I claim:

1. A ground actuated lid operating system dimensioned and configured to selectively open and close a lid of a storage structure comprising:

a cable having a first end and a second end;

said cable originating at said first end from a first side of the storage structure and terminating at said second end at a second side of the storage structure;

there being a loop formed in said first end of said cable;

a securing arm pivotally attached to the storage structure and located proximate said first end of said cable;

a brace located at the top of the storage structure and attached to the lid;

said cable attached to said brace;

said loop dimensioned and configured to fit onto said securing arm, wherein when said loop is fitted onto said securing arm said securing arm is capable of securing the lid in a locked position, the lid being actuated by pulling on said second end of said cable, closed by pulling on said first end of said cable, and locked by placing said loop onto said securing arm.

2. The lid operating system according to claim 1, wherein attached to said first side is a U-shaped bracket dimensioned and configured to receive said securing arm to secure the lid in a locked position.

3. The lid operating system according to claim 2, wherein said second side is diametrically opposed to said first side, and said second side contains a holding bracket to secure said second end of said cable.

4. The lid operating system according to claim 3, wherein attached to said cable are a plurality of cable clamps for adjusting the length of said cable and dimension of said loop.

5. The lid operating system according to claim 1, further including means for attaching said cable to the uppermost part of said brace, wherein when said second end of said cable is pulled, said cable causes said brace to tilt, thereby forcing the lid to open, and when said first end of said cable is pulled, said cable causes said brace to force the lid into a closed position.

6. The lid operating system according to claim 5, wherein located on the storage structure is an eyebolt through which said cable travels, said eyebolt thus functioning as a guide for said cable.

* * * * *